US012753757B2

(12) United States Patent
Pierce et al.

(10) Patent No.: US 12,753,757 B2
(45) Date of Patent: Oct. 6, 2026

(54) PROCESS PUMP WITH DYNAMIC SEAL FOR DRY RUN CAPABILITY

(71) Applicant: Viking Pump, Inc., Cedar Falls, IA (US)

(72) Inventors: Justin Pierce, Waterloo, IA (US); Joseph Papp, Cedar Falls, IA (US); Andrew Anderson, Cedar Falls, IA (US)

(73) Assignee: Viking Pump, Inc., Cedar Falls, IA (US)

( * ) Notice: Subject to any disclaimer, the term of this patent is extended or adjusted under 35 U.S.C. 154(b) by 0 days.

(21) Appl. No.: 18/901,420

(22) Filed: Sep. 30, 2024

(65) Prior Publication Data

US 2025/0116271 A1 Apr. 10, 2025

Related U.S. Application Data

(60) Provisional application No. 63/588,346, filed on Oct. 6, 2023.

(51) Int. Cl.

| | |
|---|---|
| ***F04C 2/10*** | (2006.01) |
| ***F04C 2/08*** | (2006.01) |
| ***F04C 15/00*** | (2006.01) |

(52) U.S. Cl.

CPC ..... *F04C 2/102* (2013.01); *F04C 2/084* (2013.01); *F04C 15/0038* (2013.01); *F04C 2240/30* (2013.01); *F04C 2240/50* (2013.01)

(58) Field of Classification Search

CPC . F04C 2/084; F04C 2/10–102; F04C 15/0038
See application file for complete search history.

(56) References Cited

U.S. PATENT DOCUMENTS

| | | | | |
|---|---|---|---|---|
| 2,672,100 A * | 3/1954 | Harvey | F04C 2/14 | 277/562 |
| 3,072,066 A * | 1/1963 | Kennedy | F04C 15/0038 | 418/83 |
| 2014/0271311 A1* | 9/2014 | Schepp | F04C 15/0026 | 418/191 |

(Continued)

OTHER PUBLICATIONS

Viking Pump, "127A Series™, 4127A Series™, 327A Series™, 4327A Series™," Specification Sheet, Jul. 2021, Form 1701.

(Continued)

*Primary Examiner* — Laert Dounis
(74) *Attorney, Agent, or Firm* — Tucker Ellis LLP; Michael G. Craig; Anna Nelson

(57) ABSTRACT

One or more techniques and/or systems are disclosed for a positive displacement pump. The pump includes a pump housing having an inlet and an outlet. An internal gear assembly is arranged along a fluid pathway between the inlet and outlet and includes a shaft, a rotor gear, and an idler gear. The rotor gear is operably coupled to a first end of the shaft. A first bearing is arranged around the shaft. The seal holder plate is arranged between the first bearing and the first end of the shaft. A first sealing element is concentrically arranged between the shaft and the seal holder plate to seal and isolate the first bearing from fluid traveling between the inlet and the outlet. The first bearing, the seal holder plate, and the first sealing element are arranged in a packing box portion of the pump housing that is isolated from the fluid.

20 Claims, 5 Drawing Sheets

(56) References Cited

U.S. PATENT DOCUMENTS

| | | | | |
|---|---|---|---|---|
| 2016/0298623 | A1* | 10/2016 | Meyer | F04C 2/084 |
| 2018/0372221 | A1* | 12/2018 | Wilkins | F16J 15/32 |
| 2019/0383399 | A1* | 12/2019 | Mihm | F16J 15/183 |
| 2020/0400141 | A1* | 12/2020 | Iehl | F16J 15/183 |
| 2021/0048023 | A1* | 2/2021 | Crawford | F04C 2/18 |

OTHER PUBLICATIONS

Viking Pump, "O-Pro® Seal Technology—Simple, Proven & Reliable," Specification Sheet, May 2022, Form 1983.

* cited by examiner

PROCESS PUMP WITH DYNAMIC SEAL FOR DRY RUN CAPABILITY

RELATED APPLICATIONS

This application claims priority to U.S. Provisional Application Ser. No. 63/588,346 filed on Oct. 6, 2023, which is incorporated herein by reference in its entirety.

BACKGROUND

Tank trucks are used to house and transport large amounts of fluid such as petroleum products and chemicals. A pump may be attached to the tank truck to help move fluids into and/or out of the tank truck. Various types of pumps can be used; the types, power, and size of the pump may be dependent on characteristics of fluid, size of the tank truck, and the like. For example, a positive displacement internal gear pump may be used on a tank truck because of its ability to handle various types of fluids that may be contained in the tank over the tank truck's lifetime.

SUMMARY

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter.

Provided herein is a positive displacement pump comprising an internal gear assembly that is dry run capable and repairable with replacement parts, thereby increasing the longevity of the pump. In one implementation, the positive displacement pump may include an inlet, an outlet, and a fluid pathway arranged between the inlet and the outlet. An internal gear assembly is arranged along the fluid pathway. The internal gear assembly comprises an idler gear and a rotor gear, wherein the idler gear is surrounded by inner surfaces of the rotor gear. The rotor gear is operably coupled to a shaft. The rotor gear is configured to rotate upon rotation of the shaft, and the rotation of the rotor gear causes the idler gear to rotate. As the internal gear assembly rotates, fluid is sucked into and expelled out of spaces between the rotor gear and the idler gear to pump the fluid between the inlet and the outlet. The shaft comprises a first end coupled to the rotor gear and a second end opposite to the rotor gear. The pump further comprises bearings arranged around the shaft and between the first and second ends of the shaft. A seal holder plate is arranged around the shaft and between the bearings and the first end of the shaft. Two sealing elements are concentrically arranged between the shaft and the seal holder plate to seal and isolate the bearings from the fluid.

To the accomplishment of the foregoing and related ends, the following description and annexed drawings set forth certain illustrative aspects and implementations. These are indicative of but a few of the various ways in which one or more aspects may be employed. Other aspects, advantages and novel features of the disclosure will become apparent from the following detailed description when considered in conjunction with the annexed drawings.

BRIEF DESCRIPTION OF THE DRAWINGS

What is disclosed herein may take physical form in certain parts and arrangement of parts, and will be described in detail in this specification and illustrated in the accompanying drawings which form a part hereof and wherein.

DETAILED DESCRIPTION

Figure 1:
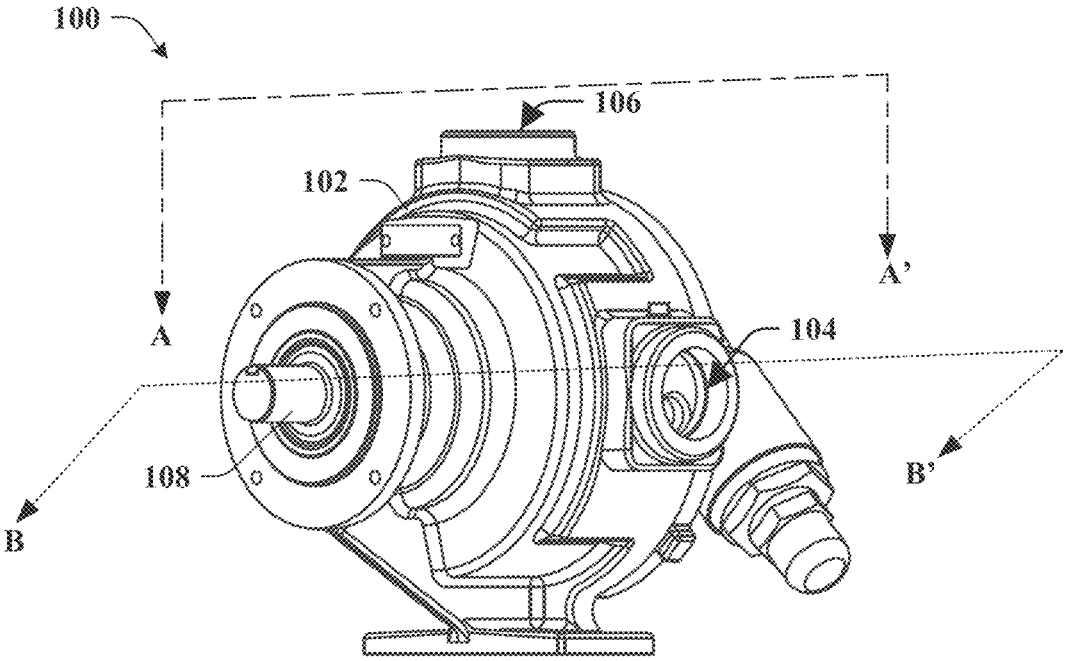
FIG. 1 illustrates a perspective view of some implementations of a process pump with dry run capability as disclosed herein.

The claimed subject matter is now described with reference to the drawings, wherein like reference numerals are generally used to refer to like elements throughout. In the following description, for purposes of explanation, numerous specific details are set forth in order to provide a thorough understanding of the claimed subject matter. It may be evident, however, that the claimed subject matter may be practiced without these specific details. In other instances, structures and devices are shown in block diagram form in order to facilitate describing the claimed subject matter.

Tank truck pumps are configured to positively displace fluids exiting or loading a tank on a truck. These pumps are subjected to difficult service conditions which can include multiple viscosities of fluid with varying lubricating properties, abrasives, temperature variations, and dry running of the pump. The effect of these conditions is reduced seal and pump life. Traditional mechanical seals fail when exposed to dry run conditions. The industry typically uses packing, sealing elements, or a combination thereof to seal the driver shaft of the pump. While these seals allow the pump to operate, they do not separate the shaft's bearings from the pumping fluid. When the bearings are subjected to low lubricating fluids and/or dry run conditions, the life of the bearings is reduced. Due to their location in the pump, the bearings cannot be repaired or replaced without special tooling. Therefore, the pump is usually discarded once failure in the seals or bearings occurs.

The disclosure herein presents some implementations of a process pump comprising a seal holder plate configured to contain sealing elements capable of sealing the pumping fluid from the bearings. The bearings may be self-lubricated and thus, can withstand dry run conditions. Additionally, the bearings can be easily accessed for replacement to increase the pump's longevity. Additional features will also be described herein that improve pump performance and longevity. It will be appreciated that the disclosed process pump is a positive displacement pump that can be used in other applications than tank trucks such as in any hydraulic driven or power take-off (PTO) driven application.

Figure 2:
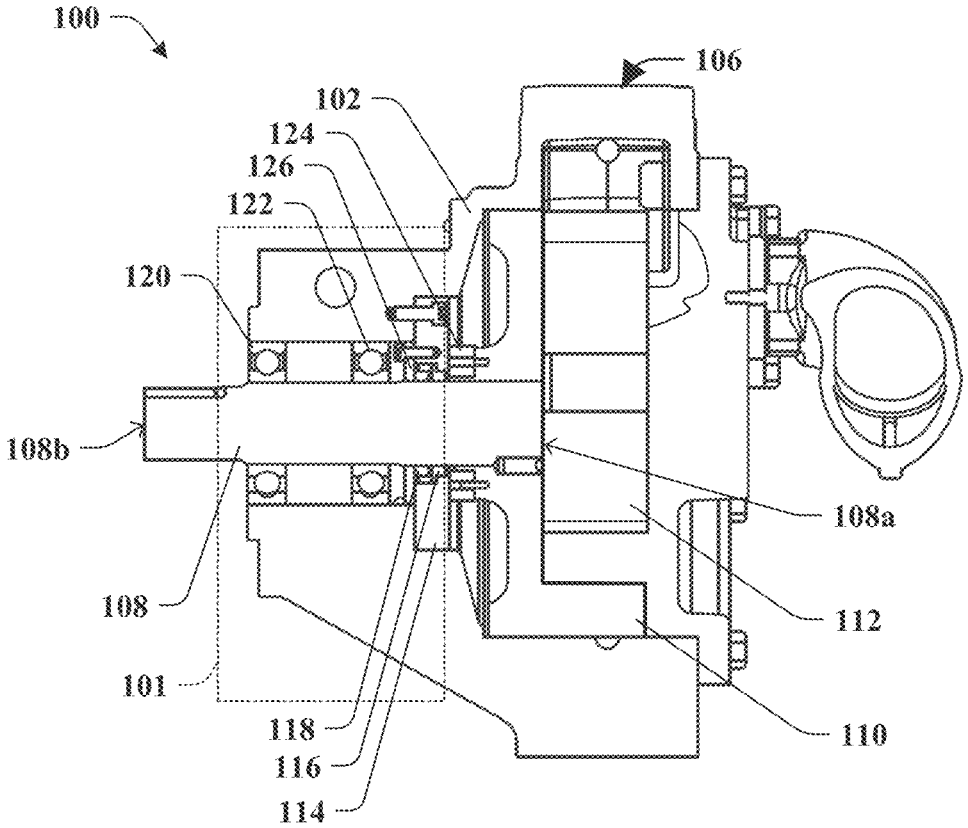
FIGS. 2 and 3 illustrate various cross-sectional views of some implementations of the process pump with bearings isolated from the pumping fluid as disclosed herein.

With reference now to FIGS. 1 and 2, some implementations of a process pump 100 will be generally described. FIG. 2 illustrates a cross-sectional view of the process pump 100 that corresponds to cross-section line AA' of the perspective view of FIG. 1.

The process pump 100 comprises a pump housing 102 having an inlet 104 and an outlet 106. Pumping fluid travels along a fluid pathway as it is drawn into the process pump 100 via the inlet 104 and expelled out of the process pump 100 via the outlet 106. In some other implementations, the inlet 104 and the outlet 106 as illustrated in FIGS. 1 and 2 can be switched such that reference numeral 104 is the outlet and reference numeral number 106 is the inlet.

The process pump 100 further comprises an internal gear assembly. The internal gear assembly includes a shaft 108, a rotor gear 110, and an idler gear 112. The shaft 108 has a first end 108*a* and a second end 108*b* opposite to the first end 108*a*. The rotor gear 110 is operably coupled to the first end 108*a* of the shaft 108. The idler gear 112 is surrounded by inner surfaces of the rotor gear 110. The second end 108*b* of the shaft 108 is configured to receive drive equipment. The pump housing 102 is designed to provide an integrated pilot and mounting bolts at the second end 108*b* of the shaft 108 for drive equipment adapters. This allows the pump 100 to be used with drive equipment connected at the second end 108*b* of the shaft 108. This reduces part complexity for users of the pump, thereby increasing user efficiency of the pump. Driven by a motor of the drive equipment, for example, the shaft 108 is configured to rotate the rotor gear 110, which in turn rotates the idler gear 112. As the rotor gear 110 and the idler gear 112 rotate, fluid is sucked into and expelled out of spaces between the rotor gear 110 and the idler gear 112 to pump the fluid between the inlet 104 and the outlet 106. In some implementations, a thrust washer 124 is arranged around the shaft 108.

The pump housing 102 includes a packing box portion 101. The packing box portion 101 is sealed from the pumping fluid by at least the first sealing element 116. Within the packing box portion 101, the pump 100 further comprises a first bearing 120 and a second bearing 122 configured to align and support the shaft 108. The bearings 120, 122 may be ring-shaped such that the shaft 108 can extend through the opening defined by inner surfaces of the ring-shaped bearings 120, 122. To preserve the life of the bearings 120, 122, a seal holder plate 114 is piloted into the pump housing 102 and is arranged around the shaft 108. Along the axial direction, which is along the length of the shaft 108, the seal holder plate 114 is arranged between the second bearing 122 and rotor gear 110. The seal holder plate 114 is configured to receive at least a first sealing element 116 and to hold the first sealing element 116 against the shaft 108 such that the first sealing element 116 is concentrically arranged between the seal holder plate 114 and the shaft 108. In some implementations, the seal holder plate 114 also receives and holds a second sealing element 118 against the shaft 108. By using two sealing elements 116, 118 the reliability of the seal from pumping fluid is increased. The thrust washer 124 and the seal holder plate 114 also control the axial thrust of the shaft 108.

Additionally, in some implementations, a seal backing plate 126 is operably coupled to the seal holder plate 114, wherein the first sealing element 116 and the second sealing element 118 are sandwiched between the seal holder plate 114 and the seal backing plate 126 in the axial direction. In some implementations, bolts or some other securing device secure the seal backing plate 126 to the seal holder plate 114. In some implementations, the seal holder plate 114 may be hardened or coated to increase its wear resistance against the thrust washer 124. Similarly, the thrust washer 124 may be hardened or coated to increase its wear resistance against the seal holder plate 114.

The first and second sealing elements 116, 118 are configured to create a seal around the shaft 108 such that the fluid flowing between the inlet 104 and the outlet 106 is sealed and isolated from the bearings 120, 122. In some implementations, the first and/or second scaling elements 116, 118 may comprise, for example, elastomers, lip seals, o-rings, or the like. In some implementations, the first and second sealing elements 116, 118 are teflon-based. It will be appreciated that other materials may be used for the first and second sealing elements 116, 118 and that the other materials used for the first and second sealing elements 116, 118 may depend on, for example, the fluid flowing through the pump 100. In the radial direction, the scaling elements 116, 118 directly contact the shaft 108. Additionally, the sealing elements 116, 118 are spaced apart from the packing box portion 101 of the pump housing 102 in the radial direction by the seal holder plate 114.

The first and second bearings 120, 122 comprise a sealed-for-life bearing that is self-lubricating. This way, the first and second bearings 120, 122 can be within the packing box portion 101, as the bearings 120, 122 do not rely on lubrication by the pumping fluid and thus, cannot be damaged during run dry conditions. Further, the first and second bearings 120, 122 are not exposed to the fluid flowing through the pump 100, which may be viscous, comprise particles, and/or comprise a material that could damage the bearings 120, 122. Thus, the first and second sealing elements 116, 118 arranged between the seal holder plate 114 and the seal backing plate 126 protect the bearings 120, 122 from the fluid thereby increasing the longevity of the bearings 120, 122. For protection against damage and debris from the surrounding environment, the first bearing 120, the second bearing 122, the first sealing element 116, and the second sealing element 118, and the shaft 108 therebetween may be continuously surrounded by the pump housing 102 within the packing box portion 101. In some implementations, because the bearings 120, 122 and the sealing elements 116, 118 can fit in the same packing box portion 101, the overall pump 100 is fairly compact and thus, useful for applications where space is limited.

Figure 3:
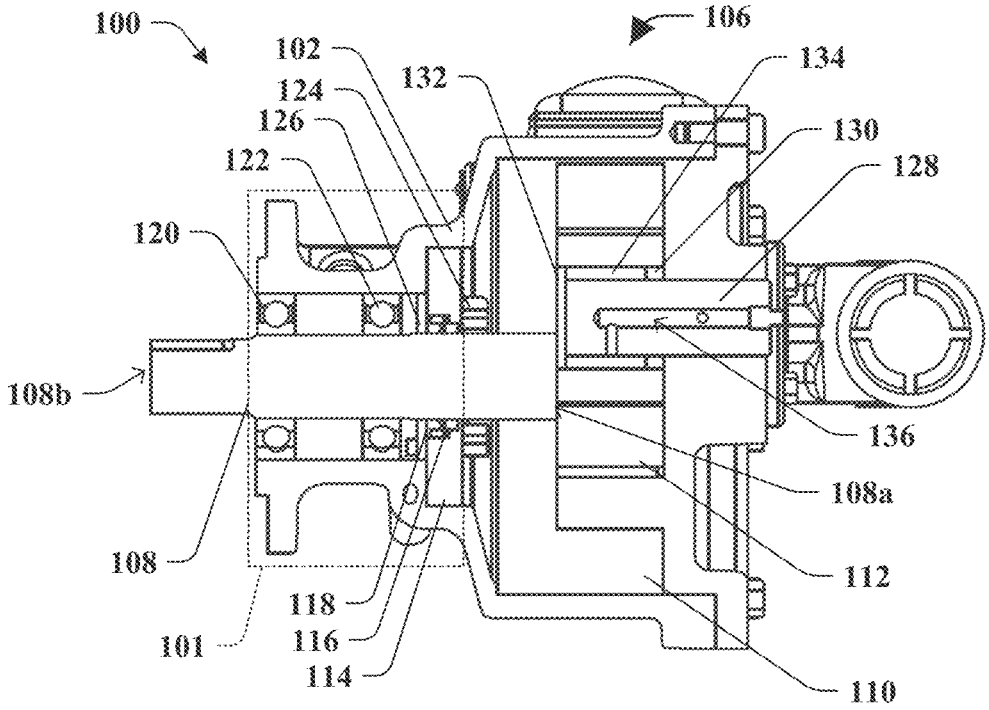

Turning additionally to FIG. 3, some implementations of the process pump 100 may comprise an externally lubricated pin assembly isolated from the pumping fluid. The cross-sectional view of FIG. 3 may correspond to cross-section line BB' of FIG. 1.

As shown in FIG. 3, the pump 100 further comprises a pin 128 operably coupled to the idler gear 112. A portion of the pin 128 may extend through a bore of the idler gear 112. Further, a first bushing seal member 130 may seal the pin 128 to a first side of the idler gear 112, and a second bushing seal member 132 may seal the pin 128 to a second side of the idler gear 112. The bore of the idler gear 112 may have a circumference that is more than a circumference of the pin 128. A bushing 134 may be arranged in the space between the idler gear 112 and the pin 128. The pin 128 comprises a lubrication pathway 136 configured to send a lubricating fluid around inner surfaces of the bushing 134 to lubricate a contact area between outer surfaces of the pin 128 and the inner surfaces of the bushing 134. The lubrication fluid is isolated from the pumping fluid traveling between the inlet 104 and the outlet 106. Further, because the bushing 134 relies on lubrication from the pin 128, the bushing 134 can be lubricated even in dry run conditions. In some implementations, the first and/or second bushing seal members 130, 132 may comprise, for example, elastomers, lip seals, welded inserts, blind pin bores, or a combination thereof.

Figure 4:
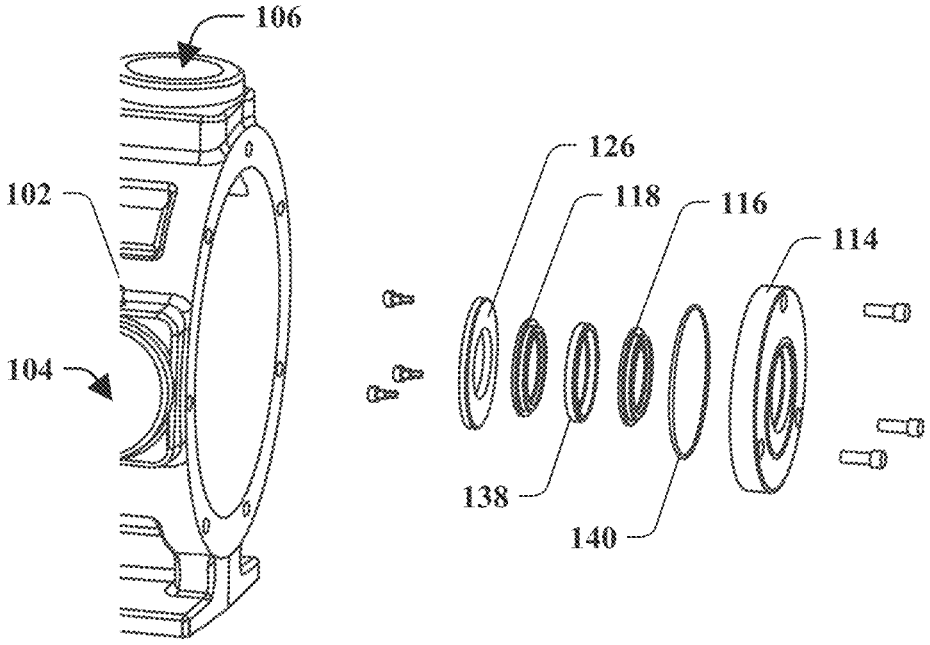
FIG. 4 illustrates an exploded view of some implementations of the seal holder plate for isolating the bearings from the pumping fluid as disclosed herein.

Turning additionally to FIG. 4, in some implementations, the first and second sealing elements 116, 118 can be accessed by removing a portion of the pump housing 102 near the inlet 104 and the outlet 106 of the pump 100. After removing the portion of the pump housing 102, the idler gear 112, and the rotor gear 110 with the shaft 108 attached, the seal holder plate 114 may be removed from the pump 100. Then, the seal backing plate 126 may be removed from the seal holder plate 114 to access the sealing elements 116, 118 without disrupting the side of the pump 100 that is operably coupled to drive equipment, adaptor bracket, flexible couplings, and the like (e.g., the side of the pump 100 at the second end 108*b* of the shaft 108).

In some implementations, a seal spacer 138 is arranged between the first sealing element 116 and the second sealing element 118 to separate the first sealing element 116 from the second sealing element 118 along an axial direction, the axial direction extending along the length of the shaft 108. In some implementations, the first and/or second sealing elements 116, 118 and the thrust washer 124 may be replaced routinely to ensure the seal remains between the process fluid and the bearing 120, 122 during operation of the process pump 100.

Further, an o-ring 140 may be arranged between the pump housing 102 and the seal holder plate 114 such that the o-ring 140 is sandwiched between the pump housing 102 and the seal holder plate 114 in the axial direction. In some implementations, the o-ring 140 comprises an elastomer. The combination of the seal holder plate 114, the first sealing element 116, the second sealing element 118, and the o-ring 140 isolates the bearings 120, 122 from the pumping fluid. Upon removal of the seal backing plate 126, the first and second sealing elements 116, 118, and the seal holder plate 114, the bearings 120, 122 may be accessed and replaced. While the bearings 120, 122 are accessible and replaceable, it can be appreciated that because the bearings 120, 122 are isolated from the pumping fluid, the bearings 120, 122 do not need to be replaced as often as if the bearings 120, 122 were exposed to the pumping fluid. Further, in some implementations, as discussed later in FIG. 7, the first bearing 120 and/or the second bearing 122 from the opposite end of the pump 100 may be accessed without removing the shaft 108 or draining the pumping fluid.

Figure 5:
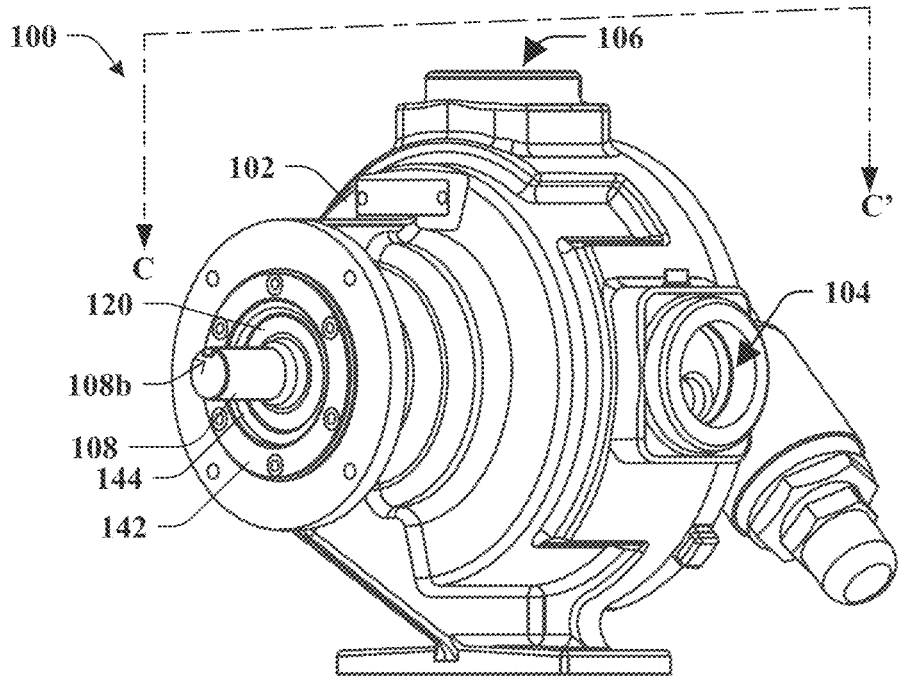
FIG. 5 illustrates a perspective view of some other implementations of a process pump with dry run capability and having a removeable bearing plate as disclosed herein.

Turning now to FIG. 5, in some implementations, the bearings 120, 122 may be accessed from an opposite side of the pump as described in FIG. 4. For example, in some implementations, the second end 108*b* of the shaft 108 may extend out of an opening in the pump housing 102. A bearing plate 142 may be piloted with the shaft 108 and arranged within the opening of the pump housing 102. The bearing plate 142 is configured to hold the first bearing 120 around the shaft 108. Further, the bearing plate 142 ensures alignment of the first bearing 120 and provides a pilot for a drive equipment mounting bracket. The bearing plate 142 and in turn the first bearing 120 hold thrust load from the shaft 108 in the axial direction towards the second end 108*b* of the shaft 108.

In some implementations, a snap ring 144 may be used to secure the first bearing 120 within the bearing plate 142 and around the shaft 108. The snap ring 144 is arranged on the inner diameter of the bore of the first bearing 120. The snap ring 144 supports the axial thrust load that is exerted on the outer race of the first bearing 120.

Figure 6:
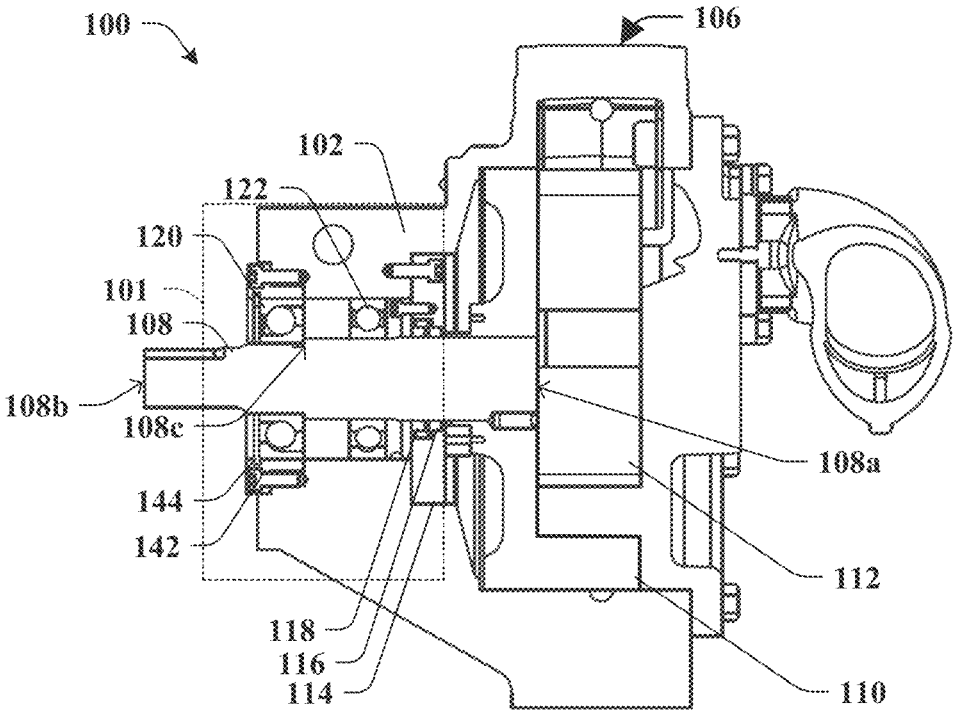
FIG. 6 illustrates a cross-sectional view of some implementations of the process pump having a removable bearing plate and a thrust bearing.

Turning additionally to FIG. 6, a cross-sectional view of the pump 100 illustrated in FIG. 5 is shown. The cross-sectional view of FIG. 6 may correspond to cross-section line CC' of FIG. 5. In some implementations, the first bearing 120 may be larger and/or different than the second bearing 122. For example, in FIG. 6, the first bearing 120 is a thrust bearing configured to control the axial shaft thrust. In some such implementations, a thrust washer (e.g., 124 of FIG. 2) is therefore omitted from the pump 100, which reduces maintenance on the pumping fluid-side of the pump 100. The area at which the shaft 108 changes in a diameter along the length of the shaft 108 may be referred to as a step 108*c*. In some implementations, the step 108*c* is arranged proximate the first bearing 120 such that the first bearing cannot move down the shaft 108 closer to the second bearing 122. Thus, the step 108*c* is arranged between the first and second bearings 120, 122. The step 108*c* of the shaft 108 supports the axial thrust load that is exerted on the inner race of the first bearing 120 in a direction towards the second end 108*b* of the shaft 108.

The remaining thrust support parts, such as the first bearing 120, are arranged on an opposite side of the sealing elements 116, 118 such that the thrust support parts are outside of the pumping fluid, thereby experiencing less wear over time. Further, in some implementations, the seal holder plate 114 may not carry any thrust because the thrust bearing 120 instead carries the thrust load. Nevertheless, the first and second bearings 120, 122 in FIG. 6 are still separated from the pumping liquid due to the first sealing element 116, second sealing element 118, and seal holder plate 114. Because the first bearing 120 is also a thrust bearing, the first bearing 120 may need to be replaced more often than the second bearing 122. Thus, the bearing plate 142 is configured to be easily removed near the second end 108*b* of the shaft 108 to ultimately access, remove, and replace the first bearing 120. In such embodiments, the first bearing 120, which does support thrust, may be arranged between the second end 108*b* of the shaft 108 and the second bearing 122 along the axial direction. Further, the first sealing element 116 and the second sealing element 118 may still be accessed and replaced as disclosed in FIG. 4.

Figure 7:
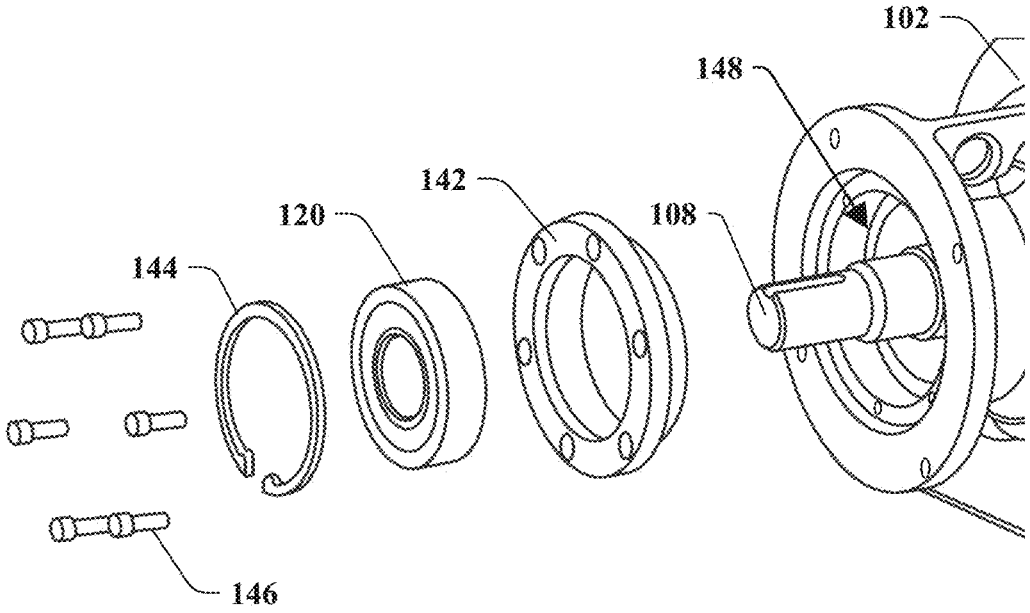
FIG. 7 illustrates an exploded view of some implementations of the removable bearing plate and thrust bearing as disclosed herein.

Turning additionally to FIG. 7, an exploded view of the bearing plate 142 and its nearby components is shown. The bearing plate 142 is designed to hold the first bearing 120 within the opening 148 of the pump housing 102. When assembled, the outer race of the first bearing 120 is surrounded by and concentrically arranged with the bearing plate 142. A portion of the bearing plate 142 is arranged directly between the outer race of the first bearing 120 and the pump housing 102. The first bearing 120 may be accessed by removing bolts 146 or some other securing member and the snap ring 144 from the bearing plate 142. The bolts 146 may secure the bearing plate 142 to the pump housing 102. Because of the sealing elements 116, 118 and the seal holder plate 114, the bearing plate 142 and the first bearing 120 can be removed from the packing box portion 101 without contamination by the pumping fluid and without removal of the shaft 108.

Figure 8:
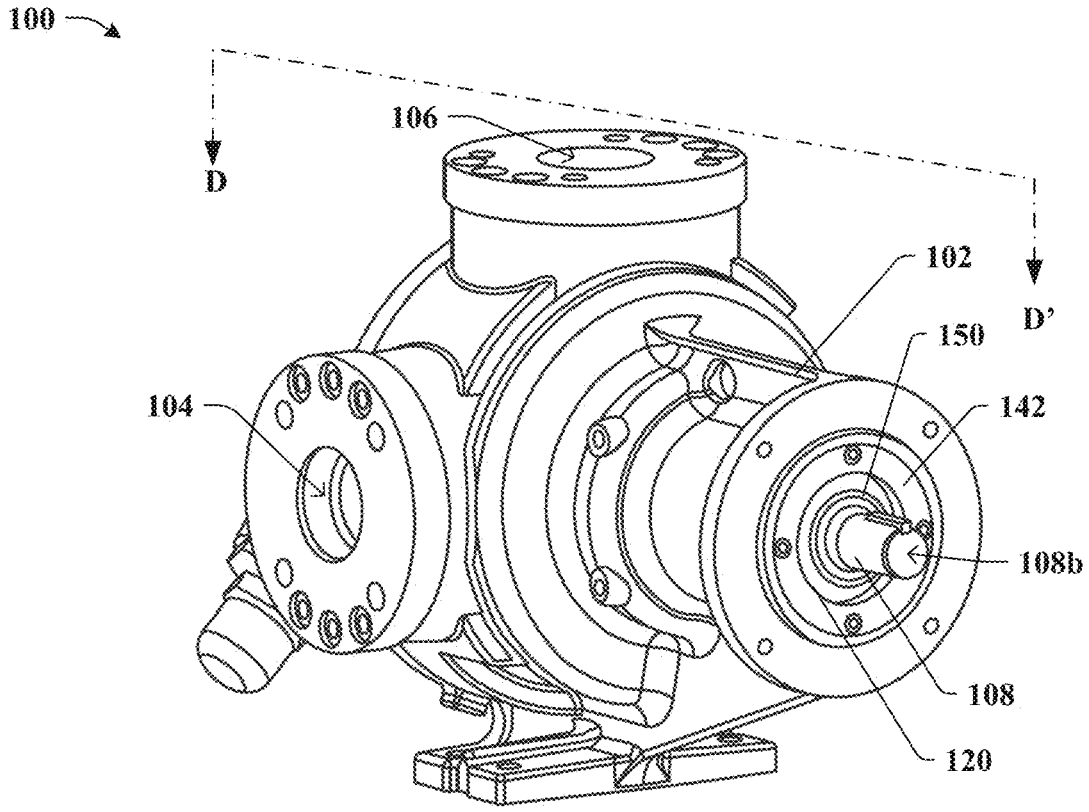
FIG. 8 illustrates a perspective view of yet some other implementations of a process pump with dry run capability and having a locknut to position the first bearing as disclosed herein.
Figure 9:
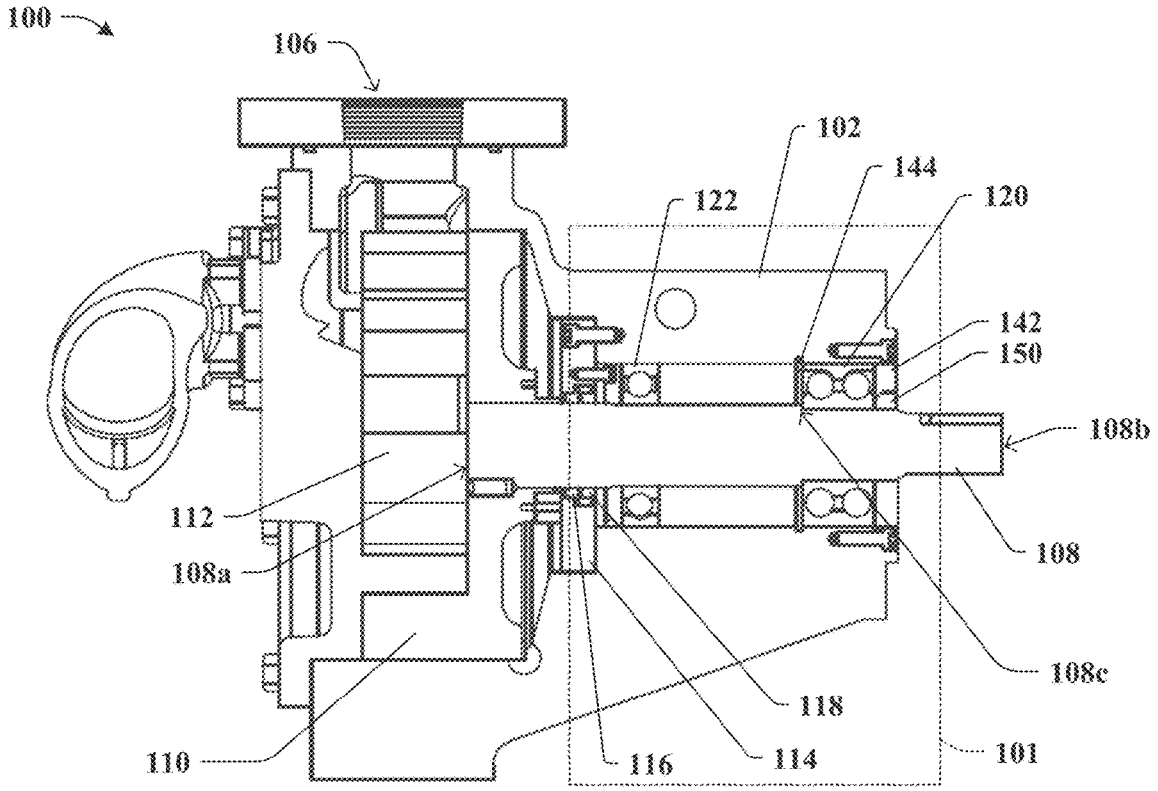
FIG. 9 illustrates a cross-sectional view of some implementations of the process pump shown having a locknut as disclosed herein.
Figure 10:
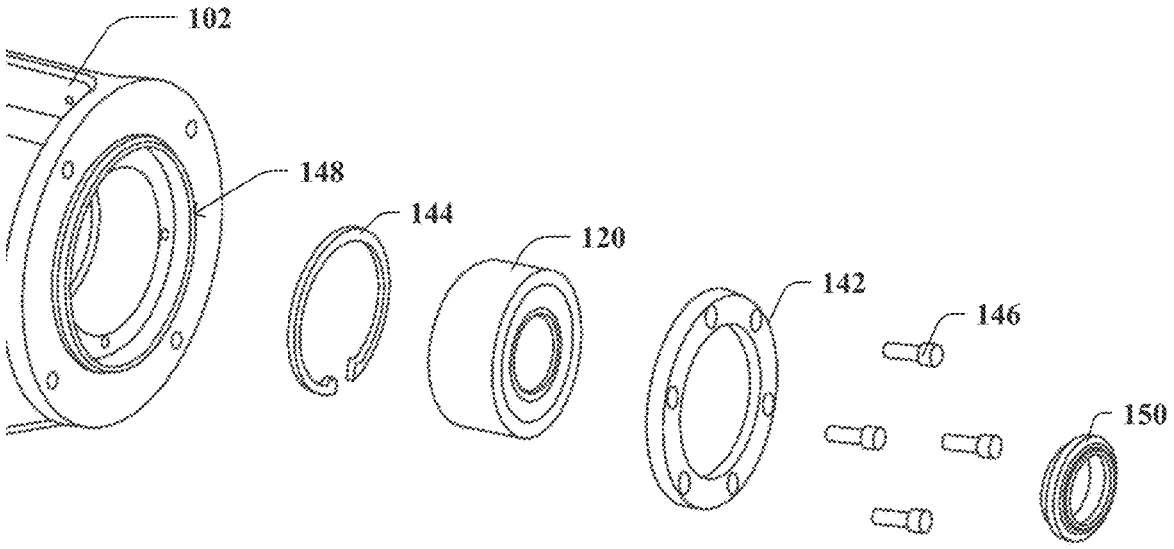
FIG. 10 illustrates an exploded view of some implementations of the removable bearings and locknut as disclosed herein.

FIGS. 8-10 illustrate yet another embodiment of a pump 100 as described herein. It will be appreciated that unless otherwise stated below, the features of the pump 100 illustrated in FIGS. 8-10 are the same as the corresponding features shown in FIGS. 5-7.

Turning now to FIG. 8, in some implementations, a locknut 150 is arranged between the first bearing 120 and the second end 108*b* of the shaft 108. The locknut 150 is configured to provide axial thrust support to the shaft 108 towards the first end 108*a* of the shaft and is configured to secure the first bearing 120 to the shaft 108.

Turning additionally to FIG. 9, a cross-sectional view of the pump 100 illustrated in FIG. 8 is shown. The cross-sectional view of FIG. 9 may correspond to cross-section line DD' of FIG. 8. In some implementations, the first bearing 120 is a double row ball bearing to provide more axial thrust support to the shaft 108. The first bearing 120 may be arranged between the snap ring 144 and the locknut 150. Thus, the snap ring 144 is arranged between the first bearing 120 and the second bearing 122 along the length of the shaft 108. The snap ring 144 also secures the first bearing 120 within the pump housing 102. The pump housing 102 is configured to hold the first bearing 120 around the shaft 108 and ensures alignment of the first bearing 120. The first bearing 120 may be arranged in a space between the shaft 108 and the pump housing 102 without the bearing plate 142 intervening between the pump housing 102 and the first bearing 120. Because of the reduced diameter in the shaft 108 at the step 108*c*, the shaft 108 can be secured to the inner race of the first bearing 120 with the locknut 150, snap ring, locking collar, or some other securing means. The locknut 150 may be surrounded by an inner surface of the bearing plate 142 such that the locknut 150 and the bearing plate 142 are concentrically arranged around the shaft 108.

The bearing plate 142 and the first bearing 120 support axial thrust load from the shaft 108 in the axial direction from the first bearing 120 towards the second end 108*b* of the shaft 108. The snap ring 144, when arranged on a side of the first bearing 120 closer to the pumping fluid, supports the axial thrust load that is exerted on the inner race of the first bearing 120 in the axial direction from the first bearing 120 towards the first end 108*a* of the shaft 108. Thus, the combination of the double ball bearing 120, the step 108*c* of the shaft 108, the snap ring 144, and the locknut 150 support axial thrust load in both directions of the shaft 108 (from the first end 108*a* to the second end 108*b*; and from the second end 108*b* to the first end 108*a*).

Turning additionally to FIG. 10, an exploded view of the first bearing 120 and its surrounding components on the shaft 108 are shown. When the first bearing 120 is arranged directly between the shaft 108 and the pump housing 102, the first bearing 120 may be removed from the gear-side of the pump 100. In some such implementations, the shaft 108 is removed from the pump 100 before the first bearing 120 can be accessed for replacing.

In some implementations, the pump 100 disclosed in FIGS. 5-10 may also comprise the pin described in FIG. 3, for example, for lubrication and isolation of the bushing 134 between the pin 128 and the idler gear 112.

The implementations have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

The word "exemplary" is used herein to mean serving as an example, instance or illustration. Any aspect or design described herein as "exemplary" is not necessarily to be construed as advantageous over other aspects or designs. Rather, use of the word exemplary is intended to present concepts in a concrete fashion. As used in this application, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Further, at least one of A and B and/or the like generally means A or B or both A and B. In addition, the articles "a" and "an" as used in this application and the appended claims may generally be construed to mean "one or more" unless specified otherwise or clear from context to be directed to a singular form.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. Of course, those skilled in the art will recognize many modifications may be made to this configuration without departing from the scope or spirit of the claimed subject matter.

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the disclosure.

In addition, while a particular feature of the disclosure may have been disclosed with respect to only one of several implementations, such feature may be combined with one or more other features of the other implementations as may be desired and advantageous for any given or particular application. Furthermore, to the extent that the terms "includes," "having," "has," "with," or variants thereof are used in either the detailed description or the claims, such terms are intended to be inclusive in a manner similar to the term "comprising."

What is claimed is:

1. A positive displacement pump comprising:

a pump housing comprising an inlet and an outlet, the pump housing having a first side that houses a pumping fluid and a second side isolated from the pumping fluid;

a fluid pathway arranged between the inlet and the outlet;

an internal gear assembly arranged along the fluid pathway and comprising:

a shaft extending along an axial direction and having a first end and a second end opposite to the first end, a rotor gear operably coupled to the first end of the shaft, and an idler gear surrounded by inner surfaces of the rotor gear and configured to rotate upon rotation of the rotor gear, wherein as the rotor gear and idler gear rotate, fluid is sucked into and expelled out of spaces between the rotor gear and the idler gear to pump the fluid between the inlet and the outlet;

a first bearing arranged around the shaft and between the first and second ends of the shaft;

a seal holder plate arranged around the shaft and between the first bearing and the first end of the shaft;

a first sealing element concentrically arranged between the shaft and the seal holder plate to seal and isolate the first bearing from the fluid, the first sealing element separating the first side of the pump housing from the second side of the pump housing; and a seal backing plate operably coupled to the seal holder plate, wherein the first sealing element is sandwiched between, in the axial direction, the seal holder plate and the seal backing plate, wherein the seal holder plate, and the first sealing element, and the seal backing plate are sized and shaped such that the seal holder plate, and the first sealing element, and the seal backing plate are merely accessible and removable from the first side of the pump housing.

2. The positive displacement pump of claim 1, wherein the first bearing is a sealed-for-life bearing.

3. The positive displacement pump of claim 1, further comprising:

a second sealing element arranged between the first sealing element and the second end of the shaft, wherein the second sealing element is also concentrically arranged between the shaft and the seal holder plate, and wherein the second sealing element is also sandwiched between the seal holder plate and the seal backing plate in the axial direction.

4. The positive displacement pump of claim 3, further comprising:

a seal spacer arranged between and contacting the first sealing element and the second sealing element to separate the first sealing element from the second sealing element along the axial direction, wherein the seal spacer is a separate piece from the first sealing element, the second sealing element, and the seal holder plate.

5. The positive displacement pump of claim 1, wherein the first sealing element is a lip seal and directly contacts the shaft, and wherein the first sealing element is spaced apart from the pump housing by the seal holder plate.

6. The positive displacement pump of claim 1, wherein the second end of the shaft extends outside of the pump housing, and wherein the second end of the shaft is configured to receive drive equipment.

7. The positive displacement pump of claim 6, further comprising a bearing plate surrounding the first bearing, wherein the pump housing comprises a shaft opening that the second end of the shaft extends out of, and wherein the bearing plate is operably coupled to the pump housing at the shaft opening such that the bearing plate contains the first bearing within the housing.

8. The positive displacement pump of claim 7, wherein the bearing plate and the first bearing are removable from the pump housing at the shaft opening.

9. A positive displacement pump comprising:

a pump housing having an inlet and an outlet, the pump housing having a first side that houses a pumping fluid and a second side isolated from the pumping fluid;

a fluid pathway arranged between the inlet and the outlet;

an internal gear assembly arranged along the fluid pathway and configured to suck fluid into the pump housing at the inlet and expel the fluid out of the pump housing at the outlet, wherein the internal gear assembly comprises a shaft extending along an axial direction and having a first end and a second end opposite to the first end, the first end arranged closer to the first side of the pump housing than the second end;

a first bearing arranged around the shaft and spaced apart from the fluid, wherein the first bearing is a thrust bearing;

a first sealing element arranged between the first bearing and the internal gear assembly and configured to isolate the fluid from the first bearing, the first sealing element separating the first side of the pump housing from the second side of the pump housing:

a seal holder plate arranged between, in the axial direction, the first end of the shaft and the first sealing element, the seal holder plate being removable from the pump housing at the first side of the pump housing; and a seal backing plate operably coupled to the seal holder plate, wherein the seal holder plate is arranged between, in the axial direction, the seal backing plate and the first end of the shaft, wherein the first sealing element and the seal holder plate are sized and shaped such that the first sealing element and the seal holder plate are merely accessible and removable from the first side of the pump housing.

10. The positive displacement pump of claim 9, wherein the first sealing element directly contacts the shaft and is spaced apart from the pump housing.

11. The positive displacement pump of claim 9, further comprising a snap ring arranged around the shaft and configured to secure the first bearing at a position along a length of the shaft.

12. The positive displacement pump of claim 11, wherein the snap ring is arranged between the first bearing and the first sealing element.

13. The positive displacement pump of claim 9, wherein the first side of the pump housing is free of thrust support parts for the shaft.

14. The positive displacement pump of claim 9, wherein the first sealing element is a lip seal.

15. The positive displacement pump of claim 9, further comprising a second sealing element concentrically arranged between the shaft and the seal holder plate.

16. The positive displacement pump of claim 15, wherein the first sealing element and the second sealing element are sandwiched between the seal holder plate and the seal backing plate in the axial direction.

17. A positive displacement pump comprising:

a pump housing comprising an inlet and an outlet;

a sealing assembly arranged within the pump housing and arranged between a fluid portion of the pump housing and a packing box portion of the pump housing, the sealing assembly comprising:

a seal holder plate, a seal backing plate operably coupled to the seal holder plate, a first sealing element sandwiched between the seal holder plate and the seal backing plate, and a second sealing element sandwiched between the seal holder plate and the seal backing plate;

an internal gear assembly arranged within the fluid portion of the pump housing and configured to pump fluid from the inlet to the outlet, wherein the internal gear assembly comprises a shaft arranged within and extending through the fluid portion of the pump housing and the packing box portion of the pump housing in an axial direction; and a first bearing concentrically surrounding the shaft in the packing box portion of the pump housing, the first bearing providing axial thrust support for the shaft, wherein the sealing assembly concentrically surrounds the shaft and prevents fluid flow from the fluid portion of the pump housing into the packing box portion of the pump housing, the sealing assembly being sized and shaped such that the sealing assembly is merely accessible and removable from the fluid portion of the pump housing.

18. The positive displacement pump of claim 17, wherein the fluid portion of the pump housing is free of thrust support parts for the shaft.

19. The positive displacement pump of claim 17, wherein the first sealing element and the second sealing element are concentrically arranged between the seal holder plate and the shaft, and wherein the first sealing element and the second sealing element are axially sandwiched between the seal holder plate and the seal backing plate.

20. The positive displacement pump of claim 17, wherein the seal holder plate is arranged axially between the seal backing plate and the fluid portion of the pump housing.

* * * * *